United States Patent [19]

Konya, et al.

[11] 4,127,068

[45] Nov. 28, 1978

[54] EARTH STRATA FRACTURING METHOD

[76] Inventors: Calvin J. Konya, 23 Fairway La., Fairmont, W. Va. 26554; Robert W. Chase, Rte. 2, 105 William St., Morgantown, W. Va. 26506; Seadet Ameri, P.O. Box 579, Morgantown, W. Va. 26506

[21] Appl. No.: 862,660

[22] Filed: Dec. 20, 1977

Related U.S. Application Data

[63] Continuation-in-part of Ser. No. 764,440, Jan. 31, 1977, abandoned.

[51] Int. Cl.[2] ..... C06C 13/00

[52] U.S. Cl. ..... 102/23; 149/1; 149/35; 149/46; 149/61

[58] Field of Search ..... 102/23; 149/35, 1, 46, 149/61

[56] References Cited

U.S. PATENT DOCUMENTS 3,921,497 11/1975 Christmann ..... 102/23 X

*Primary Examiner*—Stephen J. Lechert, Jr.

[57] ABSTRACT

A method for increasing the flow of earth strata contained fluid, such as natural gas and oil, to a well shaft from surrounding rock formations by explosive fracturing said rock formations with the substantial elimination of the formation of water in the resulting rock fractures and rock formation adjacent to the fractures.

5 Claims, No Drawings

EARTH STRATA FRACTURING METHOD

This application is a continuation-in-part of copending application Ser. No. 764,440, filed Jan. 31, 1977, now abandoned.

In the extraction of earth strata contained fluid, such as natural gas and oil, it is customary to drill a vertical well shaft into which the fluid flows from the surrounding earth strata for collection and removal. Generally, in the case of natural gas and oil, the fluid is contained in surrounding rock formations. It is known that if the permeability of the surrounding rock formations is increased by explosive fracturing, the flow of fluid from said rock formations to the well may be increased. For this purpose it is known to place explosive charges in the vertical shaft of the well and if desired, force explosives into fractures and detonate the same to fracture the surrounding rock formations.

It is an object of the present invention to improve earth strata fracturing techniques employing explosive charges to increase the permeability of the surrounding rock formations resulting from explosive fracture.

A more specific object of the invention is to improve the permeability of rock formations resulting from explosive fracturing thereof by substantially eliminating the formation of water in said fractures incident to the detonation of the explosive, thereby keeping said rock formation which has been exposed to said fractures also free of water.

These and other objects of the invention, as well as a more complete understanding thereof may be obtained from the following description and specific examples.

In accordance with the present invention the flow of earth strata contained fluid, such as natural gas and oil, from rock formations surrounding a conventional well shaft is increased by increasing the permeability of the surrounding rock formation by placing an explosive adjacent to said well shaft and/or pumping explosive from said well shaft into the formation and detonating it to produce fractures in the rock formation surrounding the well shaft through which the fluid will flow to the well shaft; specifically in accordance with the present invention the formation of water incident to the detonation of said explosive is substantially eliminated, so that water is not contained in the resulting fractures in the rock formation or in the rock formation which has been exposed to said fractures. The substantial elimination of water from the fracture produced in the rock formation and the rock formation adjacent to the fractures by the detonation of the explosive increases the flow path through said fractures and rock matrix adjacent to said fractures which, in turn, increases the flow rate of the earth strata contained fluid from the rock formation to the well shaft.

The elimination of water from the rock fractures incident to explosive fracturing thereof may be achieved by using conventional explosives that do not produce water incident to detonation. Explosives of this type are compounds which do not contain the element hydrogen. Examples of conventional explosive compounds suitable for use in the practice of the invention are lead azide and LOX (liquid oxygen and carbon). Alternately, if conventional explosives are used that produce water incident to detonation, a drying agent may be added to the explosive mixture to absorb or adsorb the water produced during detonation of the explosive. Examples of suitable drying agents would be phosphorus pentoxide, magnesium oxide, barium oxide and calcium oxide. Examples of conventional explosive compounds with which these or other drying agents could be used are water gel explosives, blasting agents and conventional high explosives. Each explosive compound would require a proportion of drying agent which proportion is determined by the amount of steam generated during detonation of the specific explosive compound. This may be readily determined experimentally for each specific explosive compound. As a specific example, with ammonium nitrate and carbon with the drying agent being phosphorus pentoxide, the approximate proportions would be:

| | |
|---|---|
| ammonium nitrate | 44% |
| carbon | 4% |
| phosphorous pentoxide | 52% |

$(6NH_4NO_3 + 3C + 4P_2O_5 \rightarrow 6N_2 + 3CO_2 + 12H_2O + 4P_2O_5 \rightarrow 6N_2 + 3CO_2 + 8H_3PO_4)$ Another alternative in the practice of the invention is to use an explosive compound that produces a drying agent during detonation. Examples of explosives of this type are barium nitrate and calcium nitrate based explosives which during detonation would produce barium oxide and calcium oxide, respectively, which would act as a drying agent with respect to water formed incident to detonation of the explosive. As a specific example, with ammonium nitrate, calcium nitrate and carbon the approximate proportions would be:

| | |
|---|---|
| ammonium nitrate | 16% |
| carbon | 14% |
| calcium nitrate | 70% |

$(2NH_4NO_3 + 11C + 4\,Ca(NO_3)_2 \rightarrow 6N_2 + 11CO_2 + 4H_2O + 4CaO \rightarrow 6N_2 + 11CO_2 + 4CA(OH)_2)$

We claim:

1. In a method for increasing the flow of earth strata contained fluid, such as natural gas and oil, to a well shaft from rock formations surrounding said shaft by increasing the permeability of said rock formation by placing an explosive adjacent to said well shaft or forcing explosives into fractures adjacent to the well shaft and detonating said explosive to produce fractures in said rock formation through which said fluid will flow to said shaft, the improvement comprising substantially eliminating the formation of water during the detonation of said explosive in said fractures and in rock formation exposed to said fractures, whereby the flow of said fluid through said fractures to said well shaft is not restricted by the presence of water.

2. The method of claim 1 wherein the formation of water in said fractures is eliminated by the use of an explosive that does not produce water during detonation thereof.

3. The method of claim 1 wherein the formation of water in said fractures is eliminated by using a drying agent, in combination with said explosive, that absorbs or adsorbs water produced during detonation of said explosive to prevent said water from entering said fractures.

4. The method of claim 2 wherein said explosive is a hydrogen-free compound.

5. The method of claim 3 wherein said drying agent is a reaction product produced during detonation of said explosive.

* * * * *